US007077275B2

(12) United States Patent
Kao

(10) Patent No.: US 7,077,275 B2
(45) Date of Patent: Jul. 18, 2006

(54) TOOL SUSPENSION PLATE FOR A SCREWDRIVER SET

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 234 days.

(21) Appl. No.: 10/702,424

(22) Filed: Nov. 7, 2003

(65) Prior Publication Data

US 2005/0098516 A1 May 12, 2005

(51) Int. Cl.
*A47F 7/00* (2006.01)

(52) U.S. Cl. ..... 211/70.6; 211/60.1; 211/90.04; 206/372

(58) Field of Classification Search ..... 211/60.1, 211/69, 70.6, 90.04, 86.01, 17; 206/806, 206/807, 349, 96, 211, 443, 379, 370, 373, 206/374; 248/274.1, 226.11; 312/234, 137, 312/354, 349; D8/71, 349, 330
See application file for complete search history.

(56) References Cited

U.S. PATENT DOCUMENTS 3,337,058 A * 8/1967 Sandrick ..... 211/69
4,586,615 A * 5/1986 Quitmann ..... 211/70.6
5,988,382 A * 11/1999 Ritchie et al. ..... 206/372
6,164,463 A * 12/2000 Lee ..... 211/70.6
6,536,611 B1 * 3/2003 Chen ..... 211/70.6
6,685,018 B1 * 2/2004 Chuan ..... 206/373
6,742,653 B1 * 6/2004 Kao ..... 206/373
6,834,767 B1 * 12/2004 Lin ..... 211/70.6

* cited by examiner

*Primary Examiner*—Richard E. Chilcot, Jr.
*Assistant Examiner*—Lindsay M. Maguire
(74) *Attorney, Agent, or Firm*—Lowe Hauptman & Berner, LLP

(57) ABSTRACT

A tool suspension plate for a screwdriver set has a base, a resting flange formed on the base, a positioning bracket detachably mounted on the base, and multiple stop plates formed on the base and above the resting flange. Thereby, a screwdriver composed of a shaft and a handle is enabled to extend the shaft through the resting flange and rest the handle on the resting flange. Then, the positioning bracket is attached on the base to securely hold the handle of the screwdriver on the base. Additionally, one corresponding stop plates abuts a top of the handle to limit the screwdriver from being pulled upward. Thereby, the tool suspension plate has excellent thief-proof, displaying and retaining effects.

1 Claim, 8 Drawing Sheets

TOOL SUSPENSION PLATE FOR A SCREWDRIVER SET

BACKGROUND OF THE INVENTION

1. Field of the Invention

The present invention relates to a tool suspension plate, and more particularly a tool suspension plate adapted to hold and display a screwdriver set.

2. Description of Related Art

With reference to FIGS. 6 and 7, a conventional tool suspension rack is adapted to hold a wrench (80) and comprises a suspension plate (70) with a bottom and a bracket (72) detachably secured on the suspension plate (10). Two slits (701) are defined in the suspension plate (70) respectively at two sides near the bottom and two first apertures (702) are defined in the suspension plate (70) close to the slits (701). The bracket (72) is a U-shaped frame with a recess (not numbered) and has two connecting protrusions (721) formed on two oppositely distal ends of the bracket (72) to abut on the suspension plate (70). Each connecting protrusion (721) has a hook (722) correspondingly and detachably engaged with one respective slit (701) of the suspension plate (70). Each connecting protrusion (721) further has a second aperture (723) aligning with the first aperture (702). Thereby, a locking pin (74) is enabled to penetrate the first and second apertures (702) (723) to fasten the bracket (72) and the suspension plate (70) together.

The wrench (80) is held on the tool suspension rack by resting a first head end of the tool on the bracket (72) via the recess and usually has a second head end connected by a slender handle to the first head end (not shown) that avoids the wrench (80) from being pulled upward to escape from the tool suspension rack. Therefore, once the locking pins (74) are attached on the bracket (74) and the suspension plate (70), the wrench (80) is not detachable to prevent shoplifting. The retailer can remove the locking pins (74) to allow a customer to inspect the wrench prior to purchase. However, for other tools without two large ends separated by a slender portion, such as screwdriver, it is not suitable to use such kind of tool suspension rack. This is because although the screwdriver has a large handle at one end that can rest on the bracket it has only a straight shaft formed at the other end that means the screwdriver can exit through the recess. Therefore, the screwdriver is easily stolen from the tool suspension rack.

In order to make a suitable tool suspension structure for screwdrivers, the present invention provides a tool suspension plate to conveniently retain and display a screwdriver set.

SUMMARY OF THE INVENTION

A main objective of the invention is to provide a tool suspension plate for a screwdriver set that has theft-proof, displaying, and retaining effects.

Other objects, advantages and novel features of the invention will become more apparent from the following detailed description when taken in conjunction with the accompanying drawings.

DETAILED DESCRIPTION OF THE PREFERRED EMBODIMENT

Figure 1:
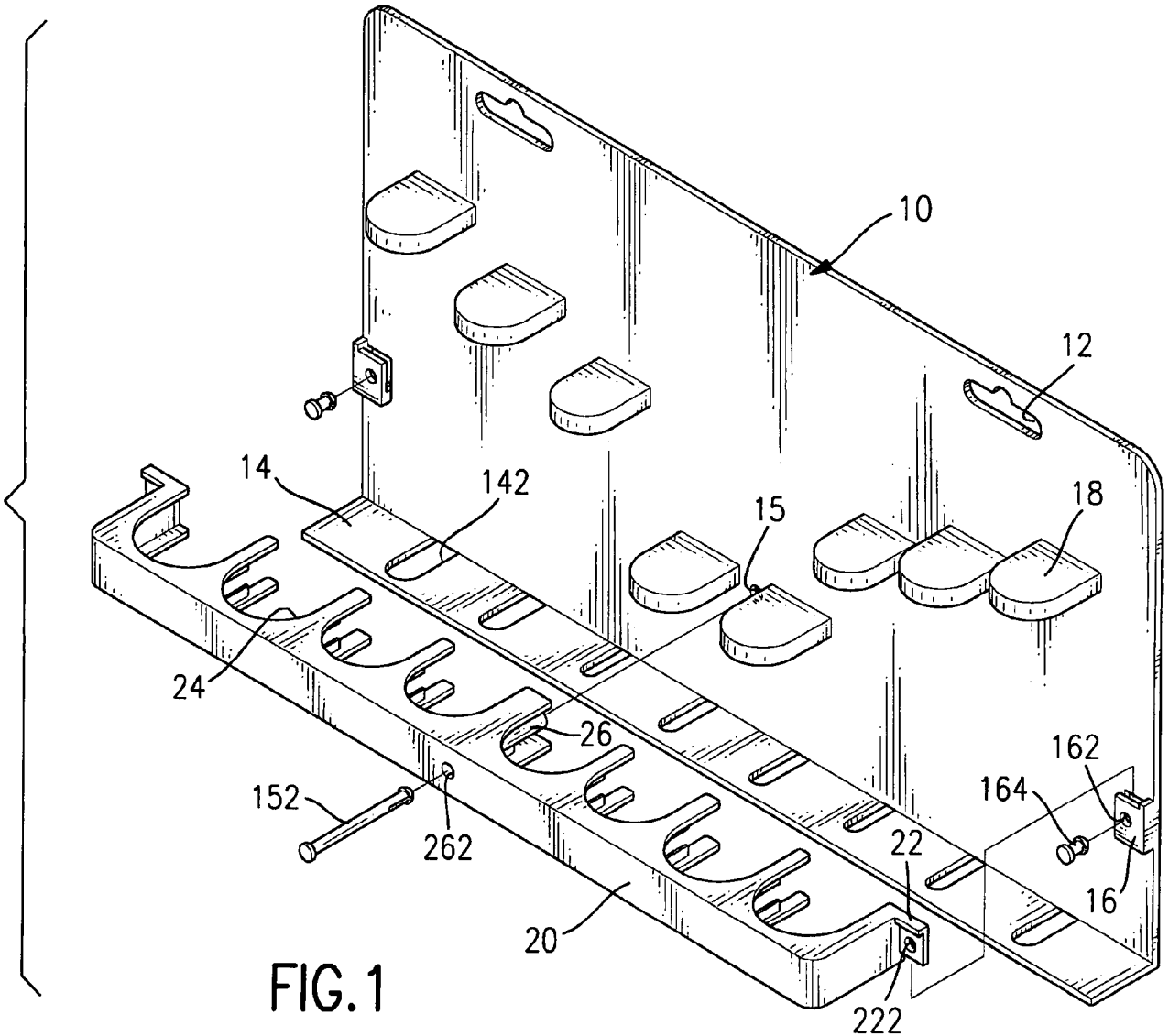
FIG. 1 is an exploded perspective view of a tool suspension plate in accordance with the present invention.
Figure 2:
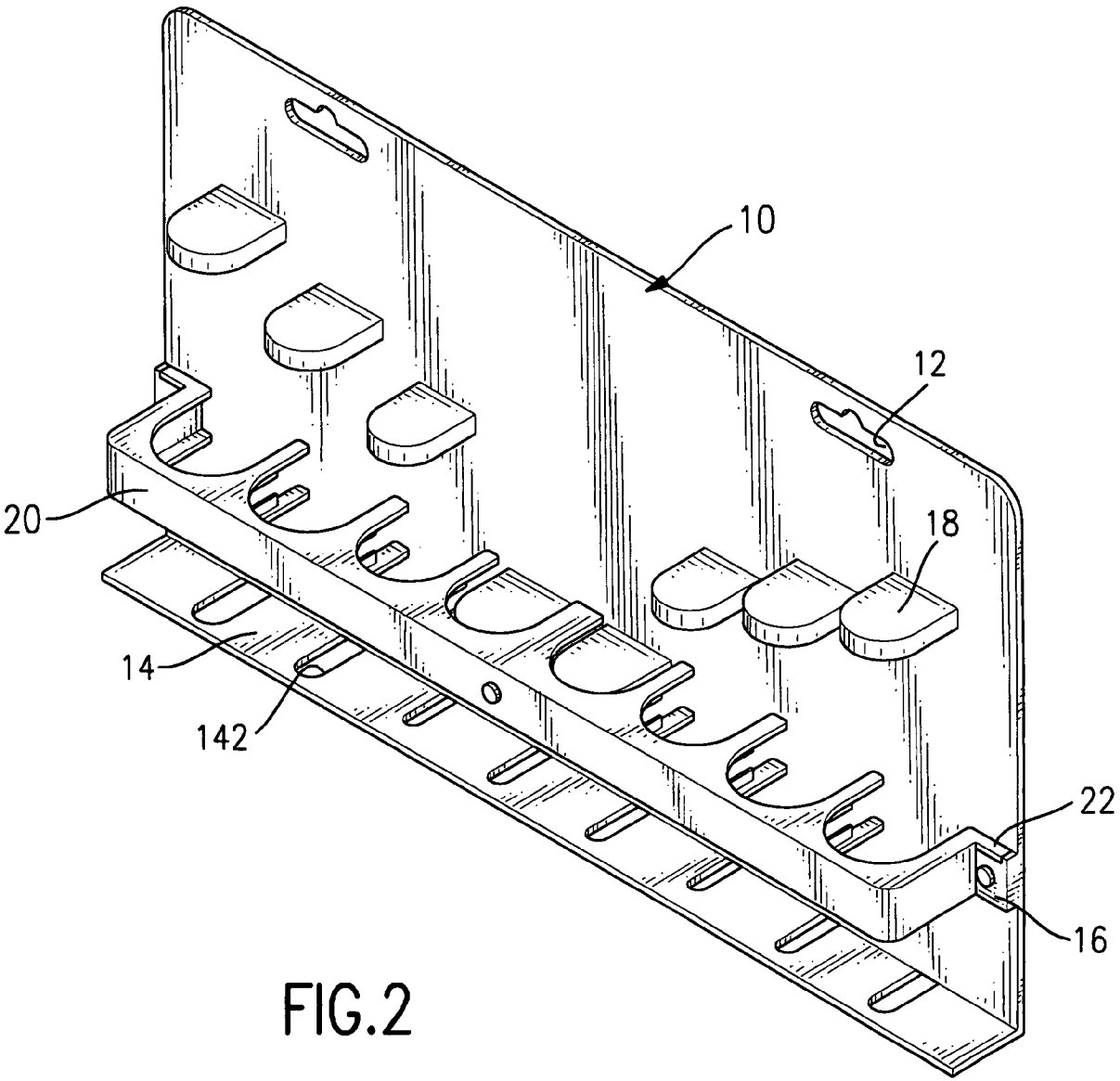
FIG. 2 is a perspective view of the tool suspension plate in accordance with FIG. 1, wherein the tool suspension plate is assembled.
Figure 3:
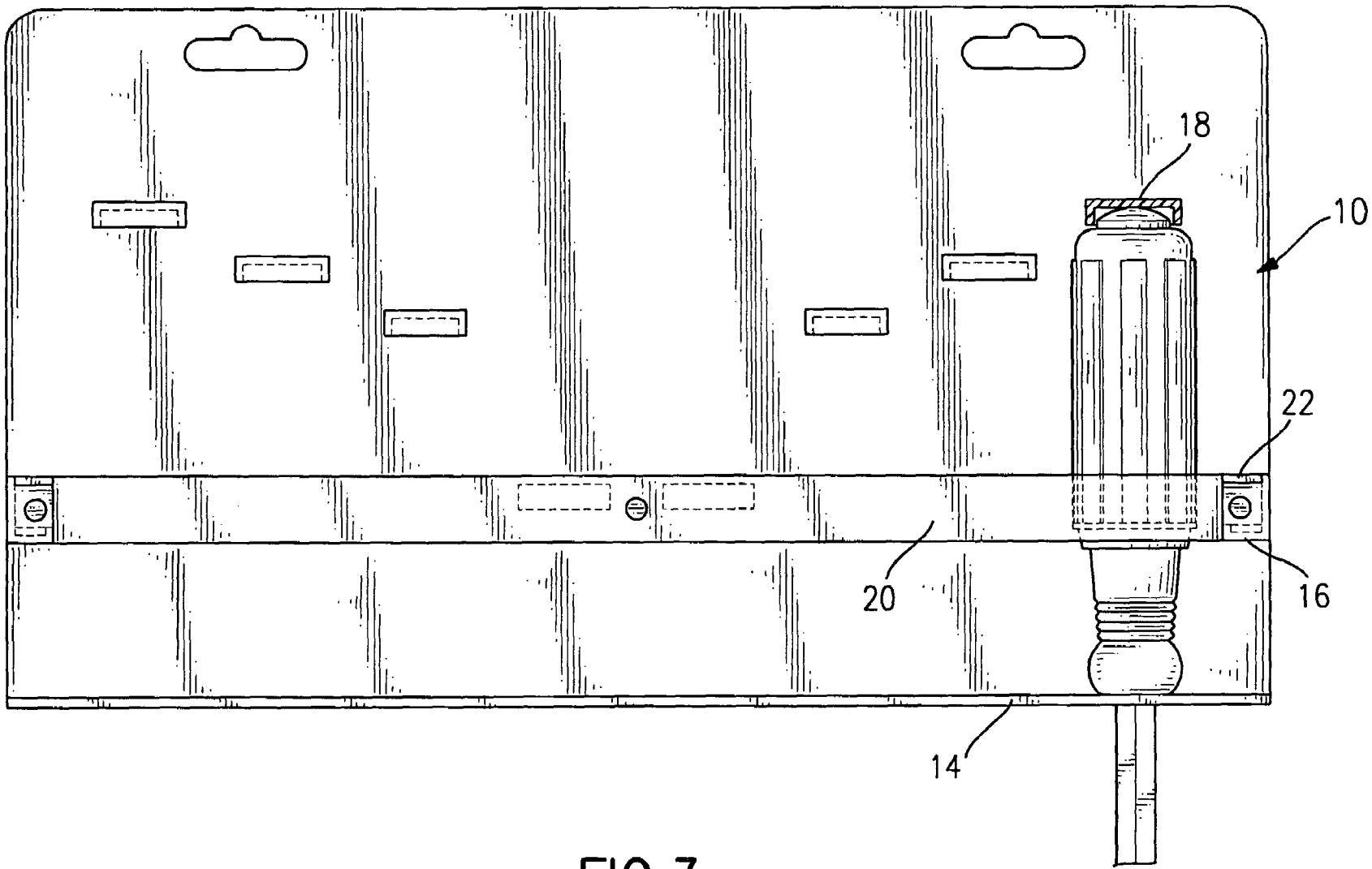
FIG. 3 is a top plane view of the tool suspension plate in accordance with FIG. 1, wherein a screwdriver is mounted on the tool suspension plate.

The tool suspension plate for a screwdriver set in accordance with the present invention comprises a base, a resting flange formed on the base, a positioning bracket detachably mounted on the base and crossing the screwdriver set to provide a thief-proof efficiency, and at least one stop plate formed on the base.

With reference to FIGS. 1, 3, 8, and 9, a tool suspension plate has the screwdriver set placed vertically and arranged one by one in a longitudinal direction. The tool suspension plate comprises a base (10) with a top, a bottom and two sides, and a resting flange (14) erectly formed at the bottom on the base (10).

The base (10) is a rectangular plate with a top and has two suspension holes (12) defined in the base (10) respectively at two sides near the top to suspend the base (10) on a desired place by means of hooks. Multiple through holes (142) of different sizes are defined in the resting flange (14) to respectively match with shafts (not numbered) of screwdrivers of different sizes in a screwdriver set. Thereby, each screwdriver is enabled to extend through one corresponding through hole (142) by the shaft and rest on the resting flange (14) when an enlarged handle (not numbered) of the screwdriver abuts the resting flange (14).

Figure 4:
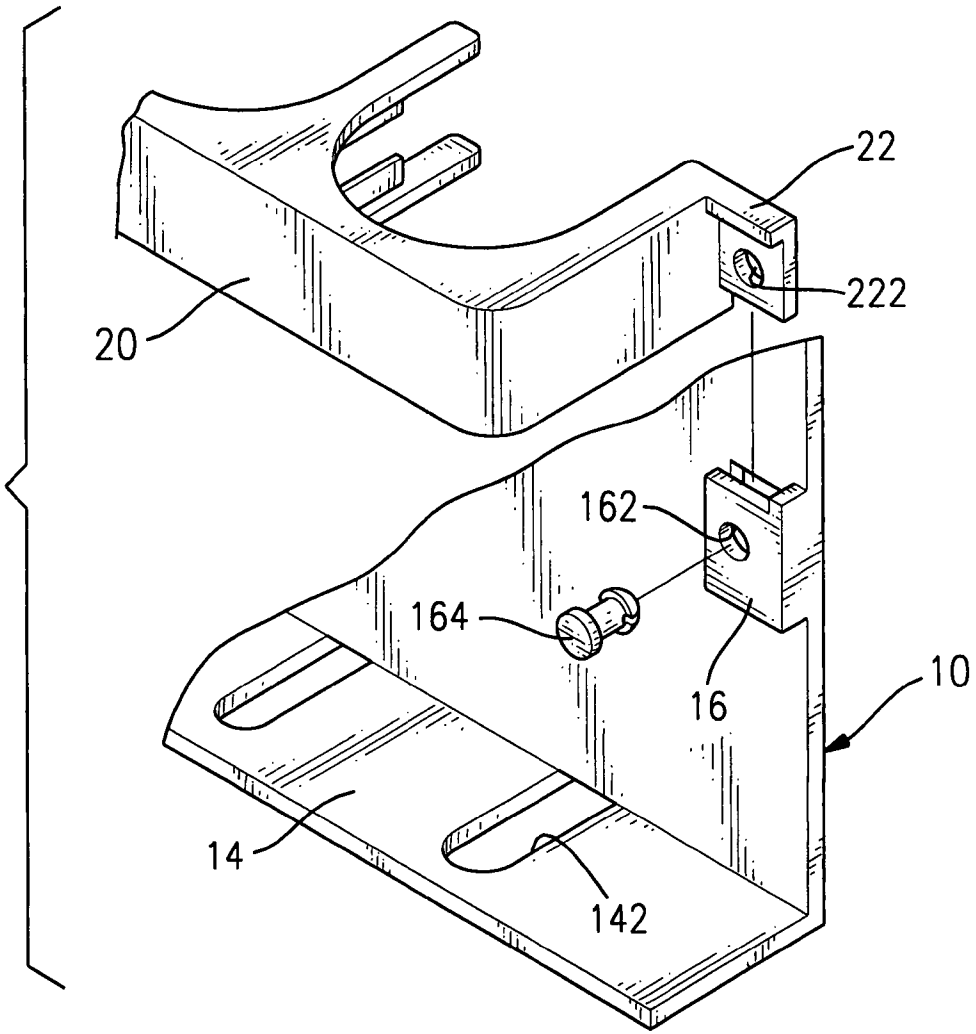
FIG. 4 is a partially enlarged exploded view of a fastening means between a plate and a positioning bracket of the tool suspension plate.

The positioning bracket (20) longitudinally crosses the base (10) over the screwdriver set and is basically a long strip with two ends and an inner side (not numbered) abutting the base (10). Multiple positioning cutouts (24) are defined in the positioning bracket (20) to align respective with the through holes (142) in the resting flange (14) when the positioning bracket (20) is mounted on the base (10) and to extend to the inner side. The positioning cutouts (24) have different sizes to respectively correspond to handles (not numbered) of the screwdrivers of different sizes in the screwdriver set. Additionally, a locking sheet (22) is formed on each end of the positioning bracket (20) and each locking sheet (22) has a hole (222) defined in the locking sheet (22). With further reference to FIG. 4, two end brackets (16) are respectively formed at two side edges of the base (10) to engage with the locking sheets (22). Each end bracket (16) is an L-shaped frame integrally formed with the base (10) and has a short plate (not numbered), a long plate (not numbered), and a locking hole (162) defined in the long plate to align with the hole (222) in the locking sheet (22). The short plate of the L-shaped frame abuts the base (10) at the edge and the long plate of the L-shaped frame is parallel with the base (10) and extends inward. Thereby, a slit (not numbered) is constructed between the long plate and the base (10) for accommodating the locking sheet (22). When the locking sheet (22) is inserted in the slit, a locking pin (164) extends through the locking hole (162) of each end bracket (16) and the hole (222) in the corresponding locking sheet (22) to fasten the positioning bracket (20) on the base (10). Preferably, the positioning bracket (20) is attached on the base (10) to cross over handles of the screwdrivers to keep the screwdriver set stay on the base (10).

Additionally, the positioning bracket (20) is a long strip and supports the handles of the screwdriver set so that a middle portion (not numbered) of the positioning bracket (20) usually overloads and deforms. Therefore, a strong post (26) with a channel (262) is formed on the positioning bracket (20) at the middle portion to abut the base (10). Moreover, a locking hole (15) is defined in the base (10) to align to the channel (262) of the strong post (26) when the positioning bracket (20) is attached on the base (10). A long locking pin (152) extends through the channel (262) and the locking hole (15) to securely hold the middle portion of the positioning bracket (20) on the base (10) to avoid the positioning bracket (20) deforming.

Additionally, multiple stop plates (18) are formed on the base (10) near the top and each stop plate (18) aligns with one of the positioning cutouts (24) to abut a top of the handle of the screwdriver. Thereby, the screwdrivers can not be drawn out from the top when suspended between the base (10) and the positioning bracket (20).

Figure 5:
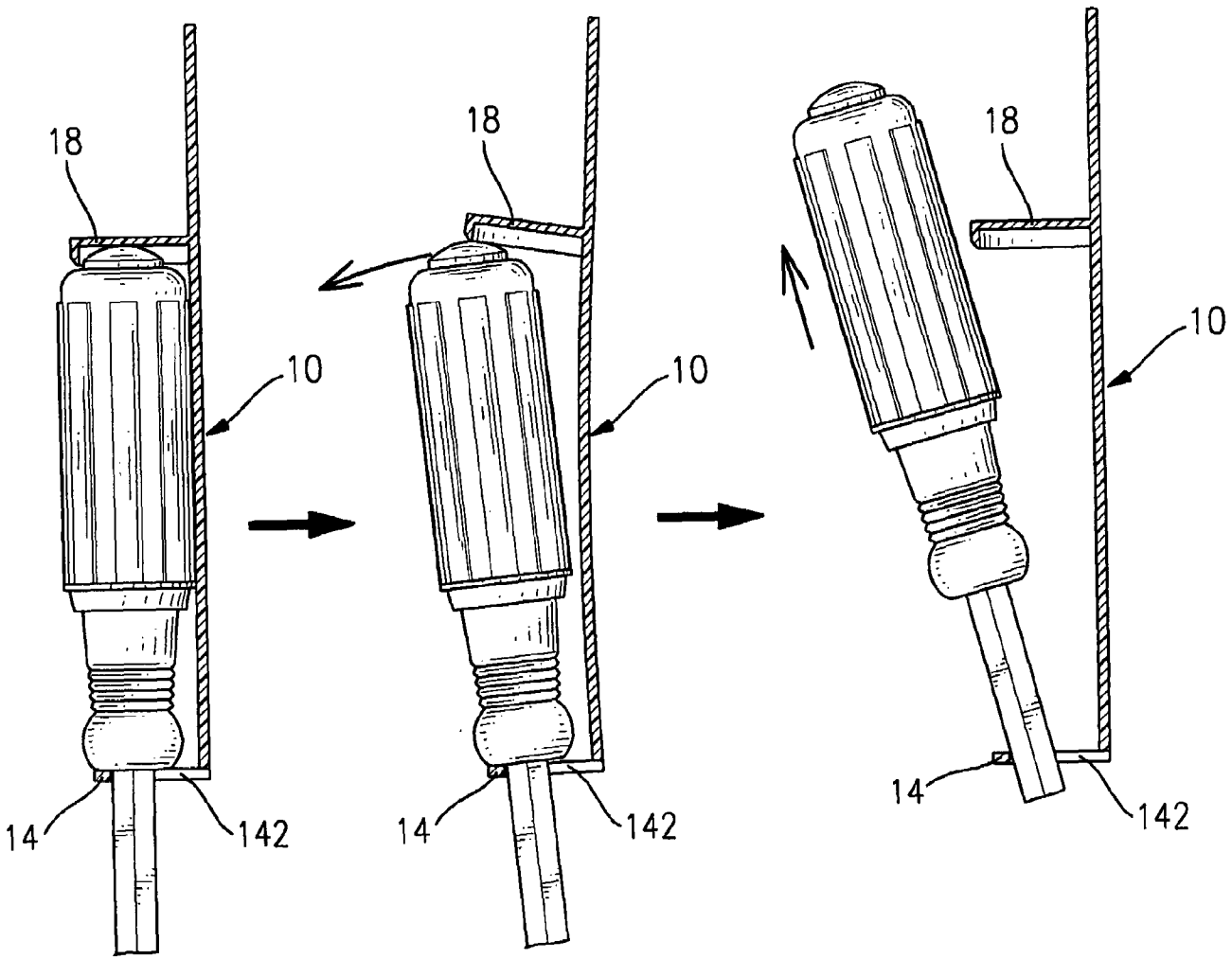
FIG. 5 is an operational side plane view of detaching the screwdriver from the tool suspension plate.
Figure 6:
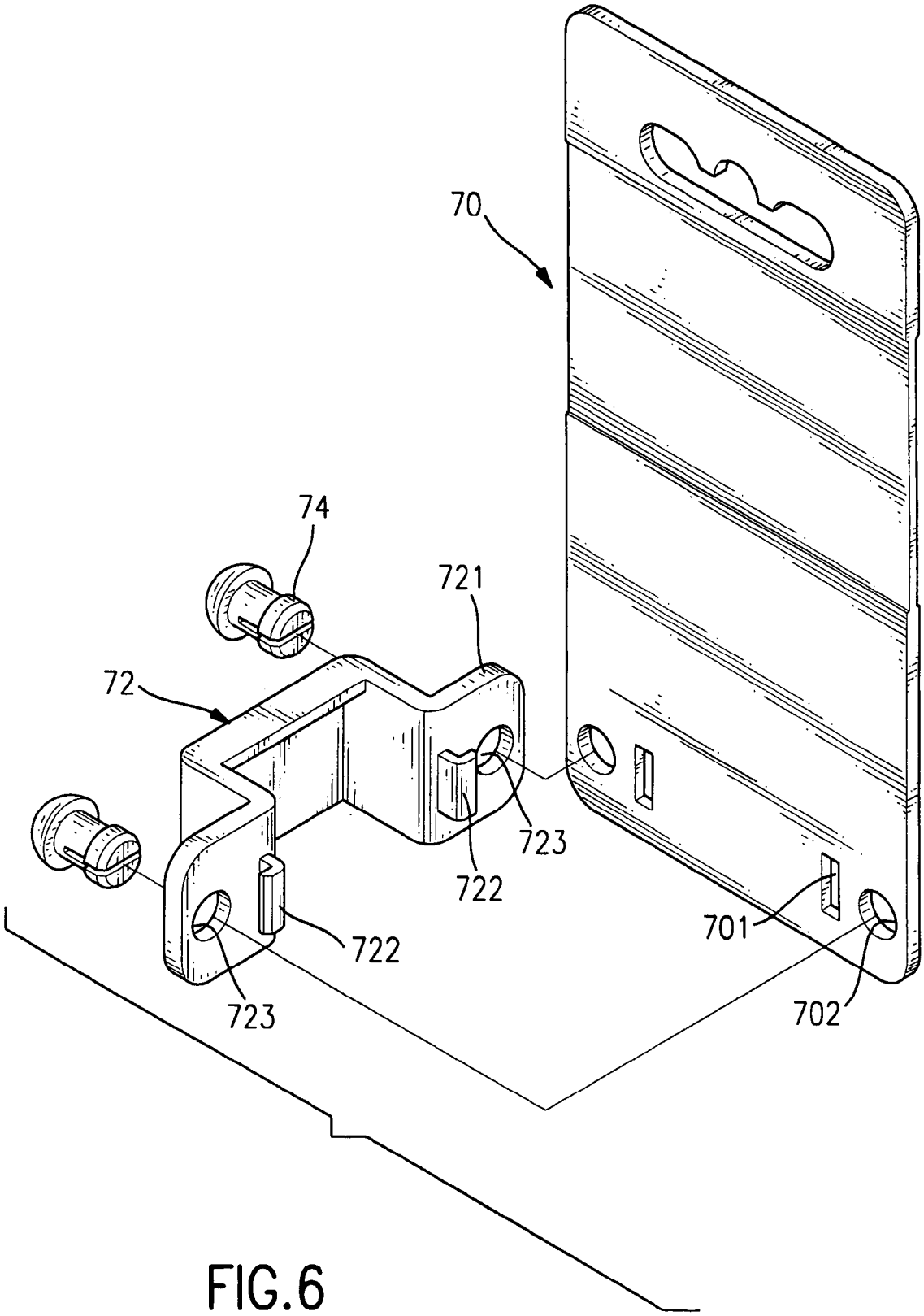
FIG.6 PRIOR ART
FIG. 6 is an exploded perspective view of a conventional tool suspension rack for a wrench in accordance with the prior art.
Figure 7:
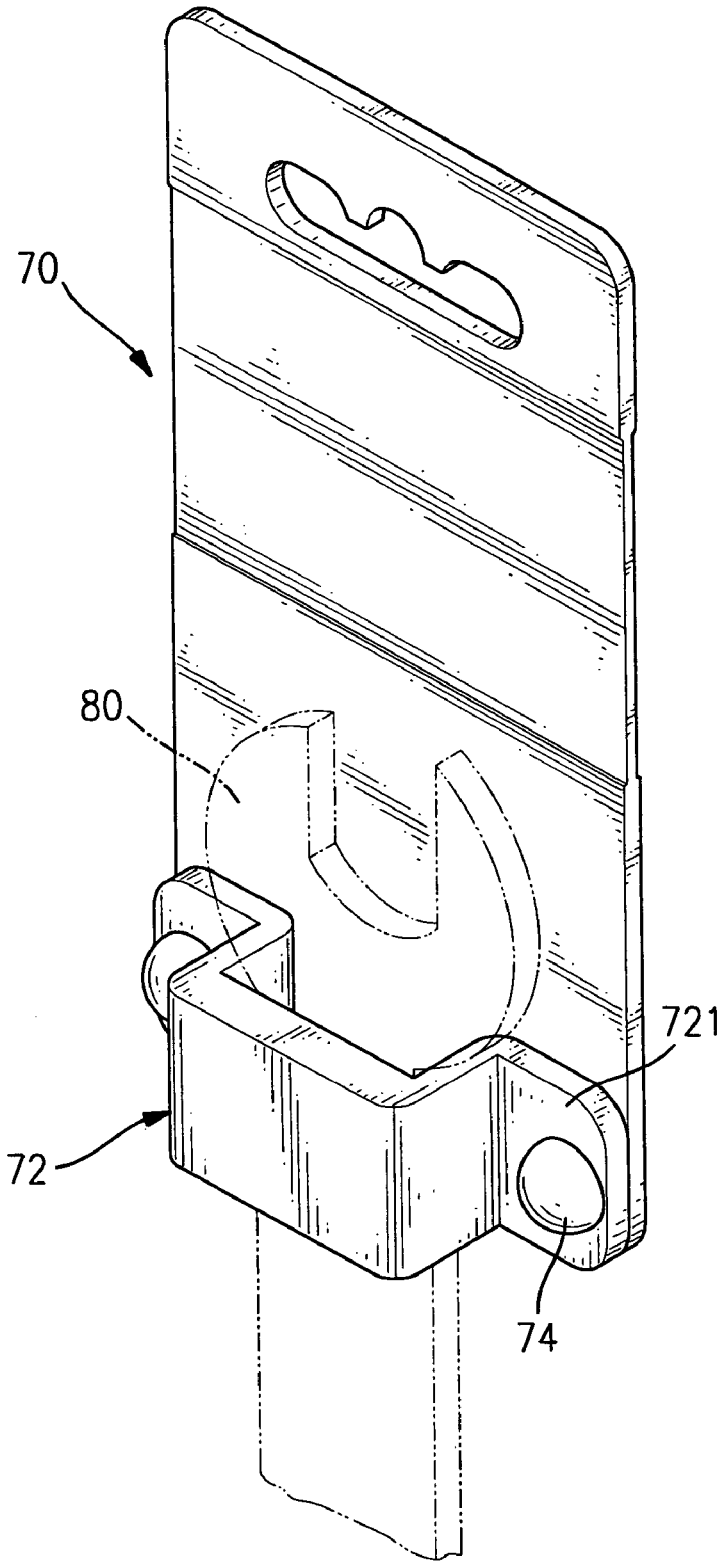
FIG.7 PRIOR ART
FIG. 7 is a perspective view of the conventional tool suspension rack, wherein the conventional tool suspension rack is assembled.
Figure 8:
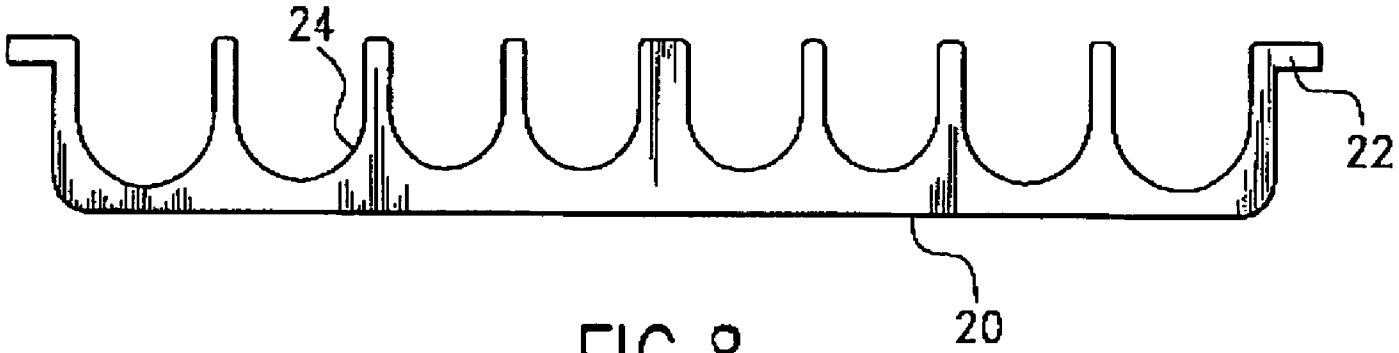
FIG. 8 is a top plane view of the positioning bracket
Figure 9:
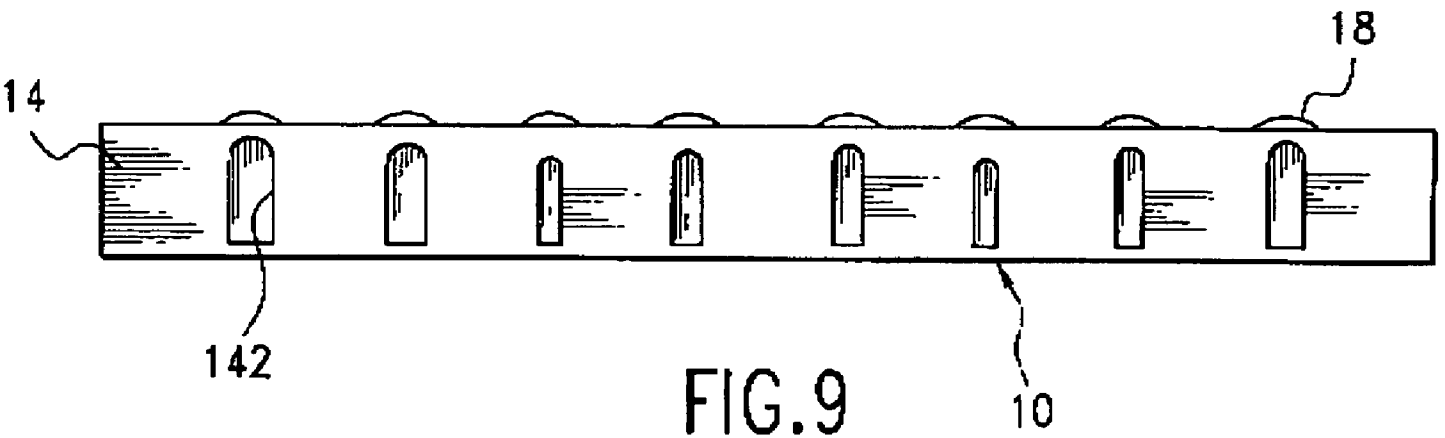
FIG. 9 is a bottom view of the resting flange.

With reference to FIG. 5, when the screwdriver is to be detached from the tool suspension plate, the positioning bracket (20) is detached from the base (10) first. Then, the screwdriver is pushed out to separate the handle from the stop plate (18). Lastly, the screwdriver is pulled upward to make the shaft completely separate from the through hole (142) of the resting flange (14).

According to the foregoing description, one screwdriver is enabled to extend through the resting flange (14) at the shaft and to rest on the resting flange (14). Then, the handle of the screwdriver is clamped within the positioning cutout (24) on the positioning bracket (20) when the positioning bracket (20) is attached on the base (10). Thereby, each screwdriver in the screwdriver set is enabled to be firmly and stably held on the tool suspension plate. Further, in cooperation with the stop plates (18), the tool suspension plate has a thief-proof efficiency to demonstrate the screwdriver set in a safe way.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A tool suspension plate for a screwdriver set comprising:

a base with a top, a bottom and two sides;

a resting flange formed on the bottom of the base and having multiple through holes defined in the resting flange in different sizes to adapt to respectively accommodate shafts of screwdrivers in the screwdriver set;

a positioning bracket detachably mounted on the base and having an inner side abutting the base and multiple positioning cutouts defined in the positioning bracket in different sizes to extend to the inner side to respectively accommodate handles of screwdrivers in the screwdriver set wherein the positioning bracket has two ends and two locking sheets respectively formed on the two ends of the positioning bracket, each locking sheet has a hole defined through the locking sheet and two end brackets are formed on the base to engage respectively with the locking sheets, each end bracket has a locking hole defined in the end bracket to align with the hole in a corresponding one of the locking sheets to engage with the locking sheet via a locking pin to fasten the positioning bracket on the base, wherein the positioning bracket is a long strip with a middle portion and has a strong post with a channel;

a locking hole is defined on the base to align with the channel; and a locking pin extends through the channel and the locking hole to securely hold the middle portion of the positioning bracket on the base to avoid the positioning bracket from deformation; and multiple stop plates formed on the base near the top, each stop plate respectively aligning with one of the through holes and adapted to abut a top of the handle of a respective one of the screwdrivers.

* * * * *